US009010885B2

(12) United States Patent
Kahle

(10) Patent No.: US 9,010,885 B2
(45) Date of Patent: Apr. 21, 2015

(54) CABINET TABLE

(71) Applicant: Kahle's Kitchens, Inc., Leeper, PA (US)

(72) Inventor: David A. Kahle, Leeper, PA (US)

(73) Assignee: Kahle's Kitchens, Inc., Leeper, PA (US)

( * ) Notice: Subject to any disclaimer, the term of this patent is extended or adjusted under 35 U.S.C. 154(b) by 64 days.

(21) Appl. No.: 13/953,168

(22) Filed: Jul. 29, 2013

(65) Prior Publication Data

US 2015/0027349 A1 Jan. 29, 2015

(51) Int. Cl.

*A47B 95/00* (2006.01)
*A47B 83/04* (2006.01)
*A47B 3/00* (2006.01)

(52) U.S. Cl.

CPC ..... *A47B 83/045* (2013.01); *A47B 3/00* (2013.01)

(58) Field of Classification Search

USPC ..... 312/241, 270.3, 25, 28, 29, 272.5, 302, 312/303, 310, 313; 108/33, 40, 41, 63, 67, 108/68, 74, 86, 88

See application file for complete search history.

(56) References Cited

U.S. PATENT DOCUMENTS

| | | | | | |
|---|---|---|---|---|---|
| 960,594 | A | | 6/1910 | Snyder | |
| 2,059,994 | A | | 11/1936 | Williams | 312/162 |
| 2,078,338 | A | * | 4/1937 | Moore | 297/147 |
| 2,081,212 | A | * | 5/1937 | Albano | 108/67 |
| 2,345,254 | A | * | 3/1944 | Graff | 312/29 |
| 2,525,201 | A | * | 10/1950 | Beynon et al. | 126/340 |
| 2,639,761 | A | * | 5/1953 | Schenzinger et al. | 297/145 |
| 2,672,384 | A | | 3/1954 | Richards | 311/16.5 |
| 2,819,141 | A | * | 1/1958 | Myer | 312/303 |
| 2,878,088 | A | * | 3/1959 | Vennice | 312/29 |
| 2,996,345 | A | * | 8/1961 | Gostin | 312/241 |
| 3,183,050 | A | * | 5/1965 | Hudson | 312/270.3 |
| 3,282,634 | A | * | 11/1966 | Maurice | 312/199 |
| 3,794,398 | A | * | 2/1974 | Lindsay | 312/241 |
| 3,953,094 | A | * | 4/1976 | Brown, Jr. | 312/303 |
| 3,999,822 | A | | 12/1976 | Nagle | 312/250 |
| 4,089,572 | A | * | 5/1978 | Flynt et al. | 312/27 |
| 4,103,633 | A | * | 8/1978 | Frank et al. | 112/217.1 |
| 4,436,353 | A | * | 3/1984 | Tucker | 312/241 |
| 4,501,457 | A | | 2/1985 | Pond | 312/314 |
| 4,592,603 | A | | 6/1986 | Adams et al. | 312/241 |
| 4,620,753 | A | * | 11/1986 | Ogden | 312/29 |
| 5,241,766 | A | * | 9/1993 | Walz et al. | 38/104 |
| D344,869 | S | | 3/1994 | Paradis et al. | D6/555 |
| 5,403,082 | A | | 4/1995 | Kramer | 312/249.9 |
| 5,513,574 | A | | 5/1996 | Collins | 108/36 |
| 7,201,439 | B2 | * | 4/2007 | Schweizer | 297/145 |
| 8,104,849 | B1 | | 1/2012 | Urioste-Risso | 312/241 |
| 2001/0052309 | A1 | * | 12/2001 | Allen | 108/33 |
| 2008/0007147 | A1 | * | 1/2008 | Skog | 312/270.3 |
| 2009/0078169 | A1 | * | 3/2009 | Osborne et al. | 108/40 |
| 2009/0266117 | A1 | * | 10/2009 | Kendall et al. | 68/13 R |

OTHER PUBLICATIONS

Four pages from Hafele Furniture/Cabinetry Hardware Catalog 2013, www.hafele.com, 4 pages.

* cited by examiner

*Primary Examiner* — Hanh V Tran
(74) *Attorney, Agent, or Firm* — Robert M. Bauer

(57) ABSTRACT

A cabinet table has a cabinet body, a front face, an interior box, and a sliding mechanism permitting the interior box to slide out of the cabinet body. The front face is connected to the interior box and has a top front face and a bottom front face. The interior box has a plurality of table components which are moveable into a table surface.

16 Claims, 11 Drawing Sheets

CABINET TABLE

FIELD OF THE INVENTION

The invention relates generally to fold out tables. In particular, the invention relates to a fold out table stored in a cabinet-like or desk-like structure.

BACKGROUND

One conventional method to improve space is the use of a fold out table stored in a cabinet-like or desk-like structure. Such a table typically includes table leafs which can open and fold out into a table position and then fold in and close to revert to the cabinet-like or desk-like structure. Examples of prior fold out tables can be found in U.S. Pat. Nos. 3,999,822, 2,672,384, and 2,059,994.

BRIEF DESCRIPTION OF THE DRAWINGS

A complete understanding of the preferred embodiments will be obtained from the following description when taken in connection with the accompanying drawing figures, wherein like reference numerals identify the same parts throughout.

DETAILED DESCRIPTION OF THE PREFERRED EMBODIMENTS

| | |
|---|---|
| 10 | cabinet containing a fold out table |
| 11 | top plate |
| 12 | front face |
| 14 | top front face |
| 16 | bottom front face |
| 18 | cabinet front frame |
| 20 | back plate |
| 22 | receptacle |
| 24 | slot |
| 25 | tracking mechanism |
| 26 | side plate |
| 28 | front plate |
| 30 | hinge |
| 31 | hinge mechanism |
| 32 | support wall |
| 34 | key |
| 35 | key notch |
| 36 | guide pin |
| 37 | intermediate plate |
| 38 | stopper |
| 39 | balance plate |
| 40 | upper balance plate piece |
| 41 | lower balance plate piece |
| 42 | large table leaf |
| 44 | small table leaf |
| 46 | hand grip |
| 48 | leaf hinge |
| 50 | lock receiver |
| 52 | lock prong |
| 56 | balance plate foot |
| 60 | side wall |
| 62 | interior box |
| 64 | cabinet body |
| 66 | holding mechanism |
| 67 | balance plate stop |
| 68 | balance plate guide track |
| 69 | balance plate clearance |
| 70 | toe space |

Figure 1:
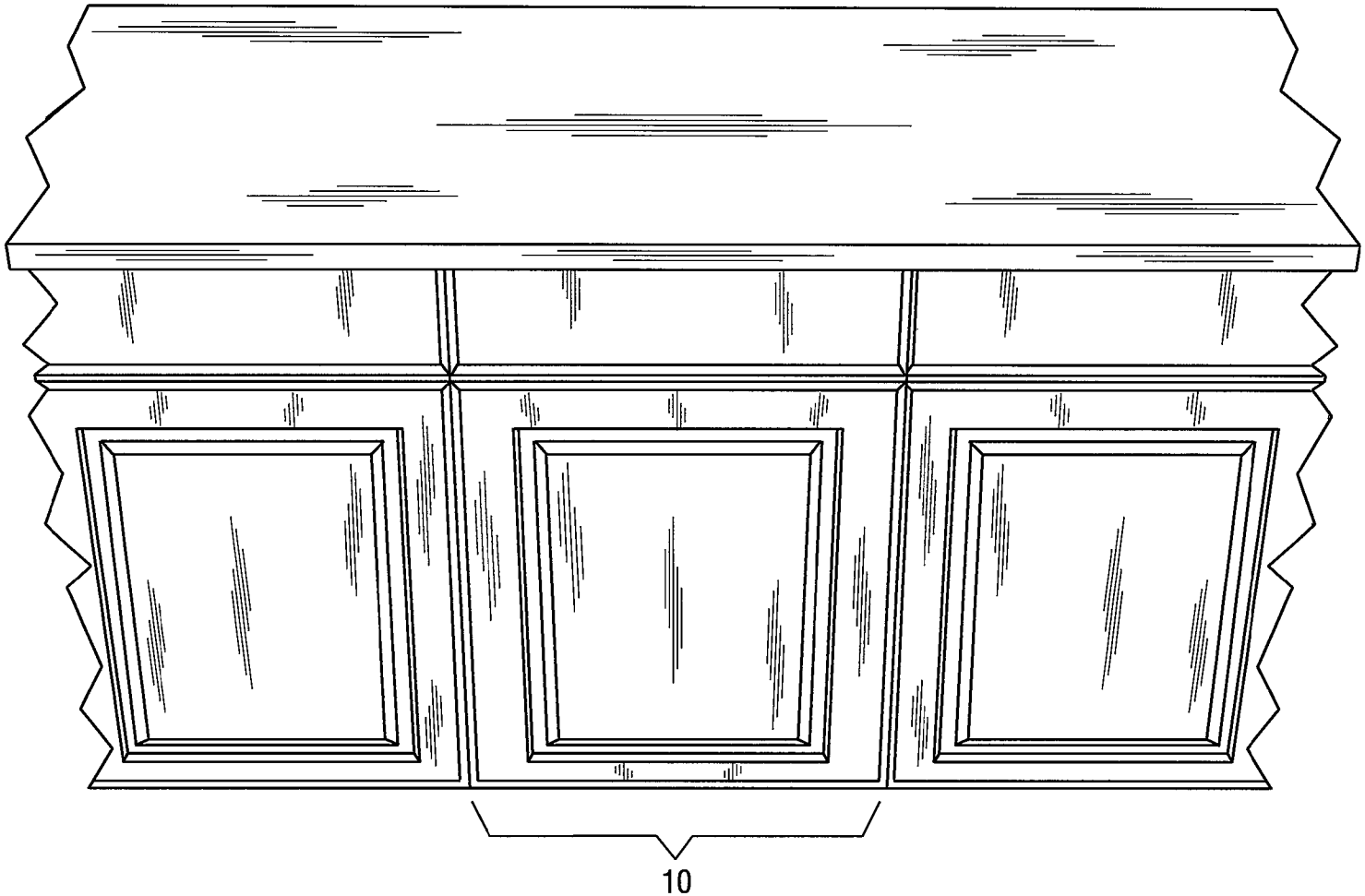
FIG. 1 is an elevated front view of a cabinet made in accordance with a preferred embodiment of the present invention with the front face thereof in a closed position.
Figure 2:
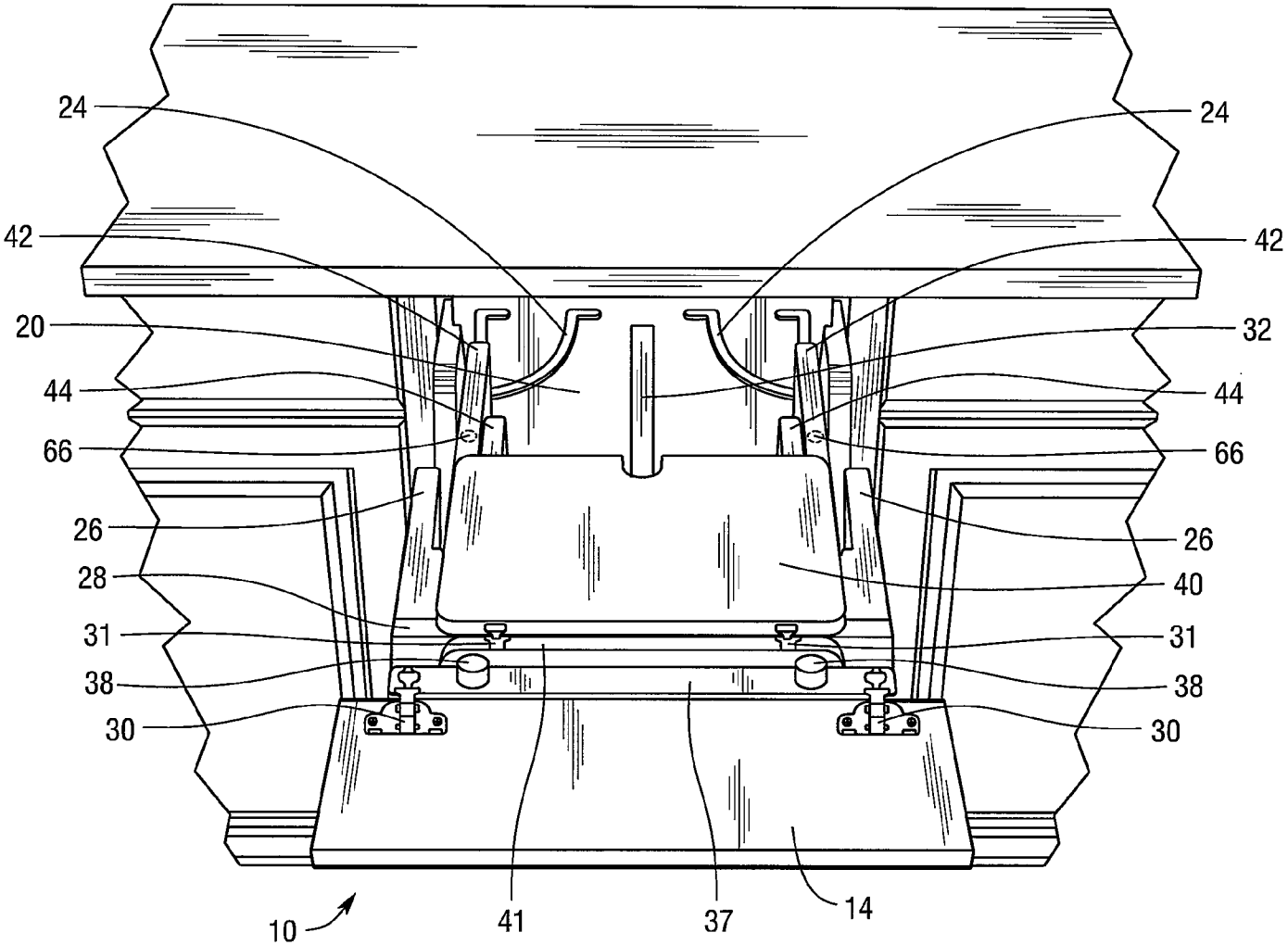
FIG. 2 is an elevated front view of the cabinet table in accordance with the preferred embodiment in the open position and an upper balance plate piece in a folded, storage position.

Referring now to the drawings, as shown in FIG. 1, a cabinet table includes a cabinet containing a fold out table 10. The cabinet containing a fold out table 10 is partially slid out and away from the cabinet body 64 to an open position as shown in FIG. 2 by a hinge 30 which attaches the top front face 14 to the intermediate plate 37 so that the top front face 14 can rotate 90 degrees away from the top plate 11 from a vertical position to a horizontal position and rest in a horizontal position that is substantially perpendicular to the bottom front face 16 when the cabinet is open. Preferably, there is at least one stopper 38 attached to the top surface of the intermediate plate 37. Due to this stopper 38, the exterior of the cabinet front frame 18 lies substantially flush against the interior of the top front face 14 when the cabinet containing a fold out table 10 is in a closed position so that it is not possible to distinguish the cabinet containing the fold out table 10 from a cabinet that does not contain a fold out table.

When the cabinet containing a fold out table 10 is slid out, there is an interior box 62 formed by a back plate 20, side plates 26, and a front plate 28. The interior box 62 is attached to the cabinet body 64 in a manner that allows the interior box 62 to slide out and away from the cabinet body 64 to an open position. An upper balance plate piece 40 is in a horizontal position over part of the interior box 62 as shown in FIG. 2. The upper balance plate piece 40 and lower balance plate piece 41 are connected via a hinge mechanism 31 so that the upper balance plate piece 40 can rotate toward the interior box 62. A balance plate clearance 69 allows the upper balance plate piece 40 to rest on the support wall 32 in a folded, horizontal, internal storage position.

Figures 3A, 3B, 3C:
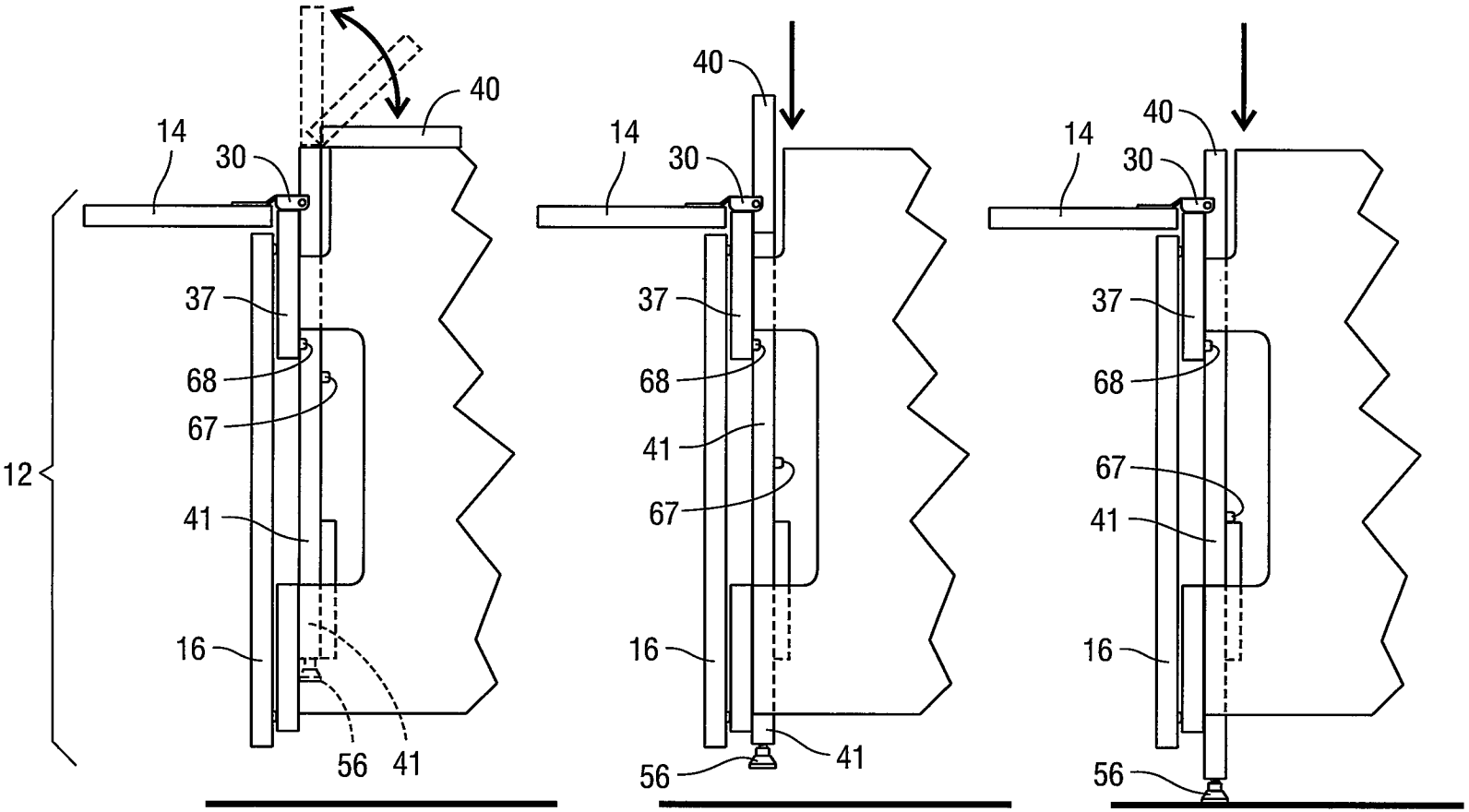
FIG. 3A is a side view of the cabinet table in FIG. 2 illustrating the upper balance plate piece moving from a folded, storage position to an unfolded, vertical position.
FIG. 3B is a side view of the cabinet table in FIG. 2 illustrating the upper balance plate piece moving downward from the unfolded, vertical position.
FIG. 3C is a side view of the cabinet table in FIG. 2 illustrating the upper balance plate piece moving to an unfolded, deployed position.

As shown in FIG. 3A, to deploy the fold out table, the upper balance plate piece 40 first rotates 90 degrees from a folded, horizontal, internal storage position in which the upper balance plate piece 40 is perpendicular to the lower balance plate piece 41 to a vertical deployed position in which the upper balance plate piece 40 is vertically aligned with the lower balance plate piece 41. As shown in FIG. 3B, after the upper balance plate piece 40 rotates to the vertical deployed position so that the upper balance plate piece 40 is vertically aligned with the lower balance plate piece 41, a balance plate guide track 68 guides the downward vertical movement of balance plate pieces 40 and 41 as gravity pulls balance plate pieces 40 and 41 toward the floor. As shown in FIG. 3C, after the balance plate guide track 68 guides the downward vertical movement of balance plate pieces 40 and 41 toward the floor, the lower balance plate piece 41 rests on the floor. The preferred embodiment includes at least one balance plate foot 56. Preferably, this balance plate foot 56 is adjustable. Due to an adjustable balance plate foot 56, it is unnecessary to have wheels which can easily damage floors and which cannot be adjusted to provide a level table surface on an unlevel floor. The preferred embodiment includes at least one finger grip located on the part of the upper balance plate piece 40 which faces the interior box. The lower balance plate piece 41 contains at least one balance plate stop 67 to stop the vertical upward motion of balance plate pieces 40 and 41 at the proper height when the upper balance plate piece 40 is pulled in a vertical upward motion to return the upper balance plate piece 40 to a storage position.

Figure 4:
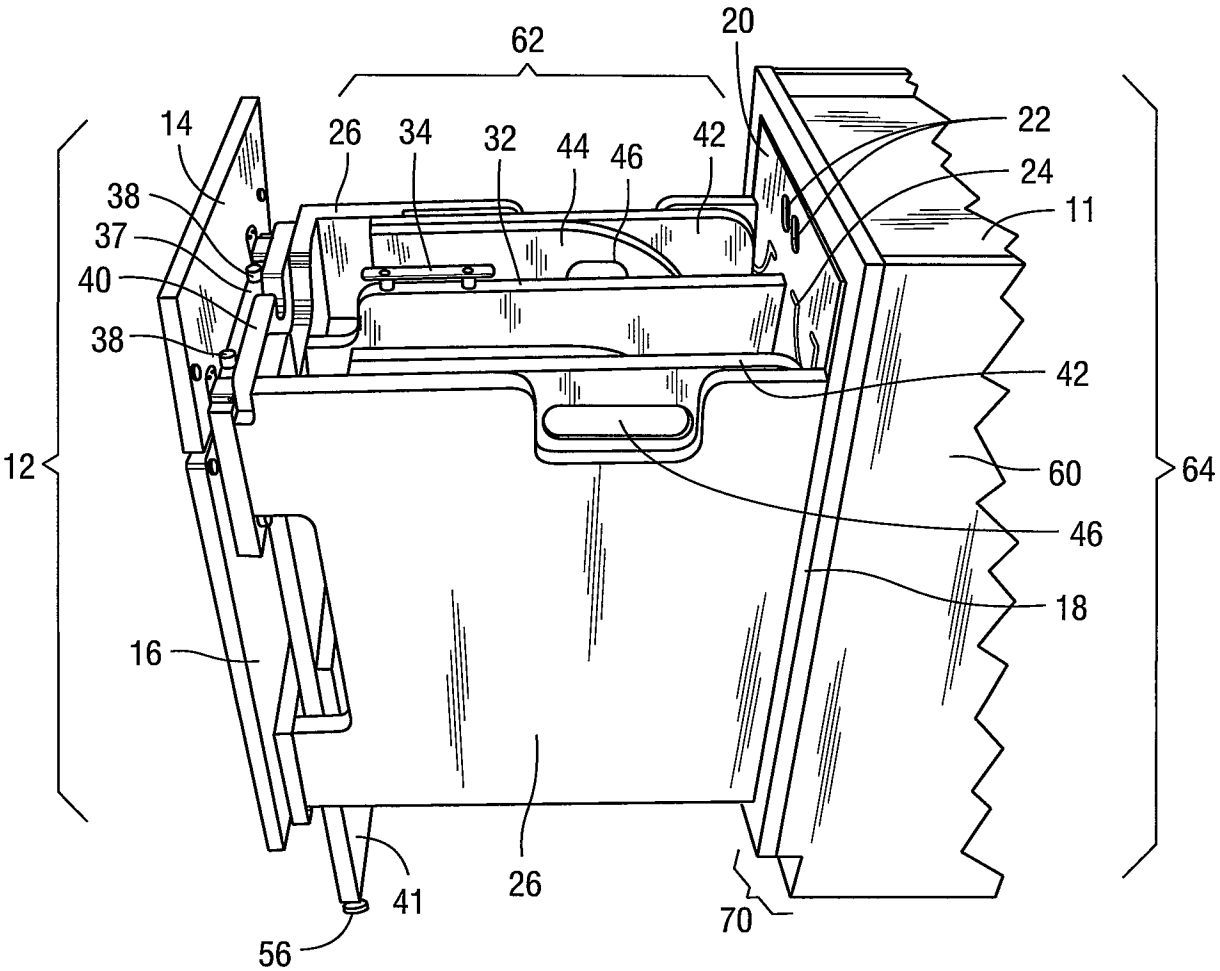
FIG. 4 is a side view of the cabinet table shown in FIG. 3C.

As shown in FIG. 4, the cabinet containing a fold out table 10 has a cabinet body 64 including a top plate 11, two substantially vertical side walls 60, toe space 70, and a cabinet front frame 18. The top plate 11 is mounted to the two substantially vertical side walls 60. The top plate 11 and side walls 60 are each attached to the cabinet front frame 18. A front face 12 contains a top front face 14 and a bottom front face 16. The top front face 14 is located above and is in vertical alignment with the bottom front face 16.

Figure 5:
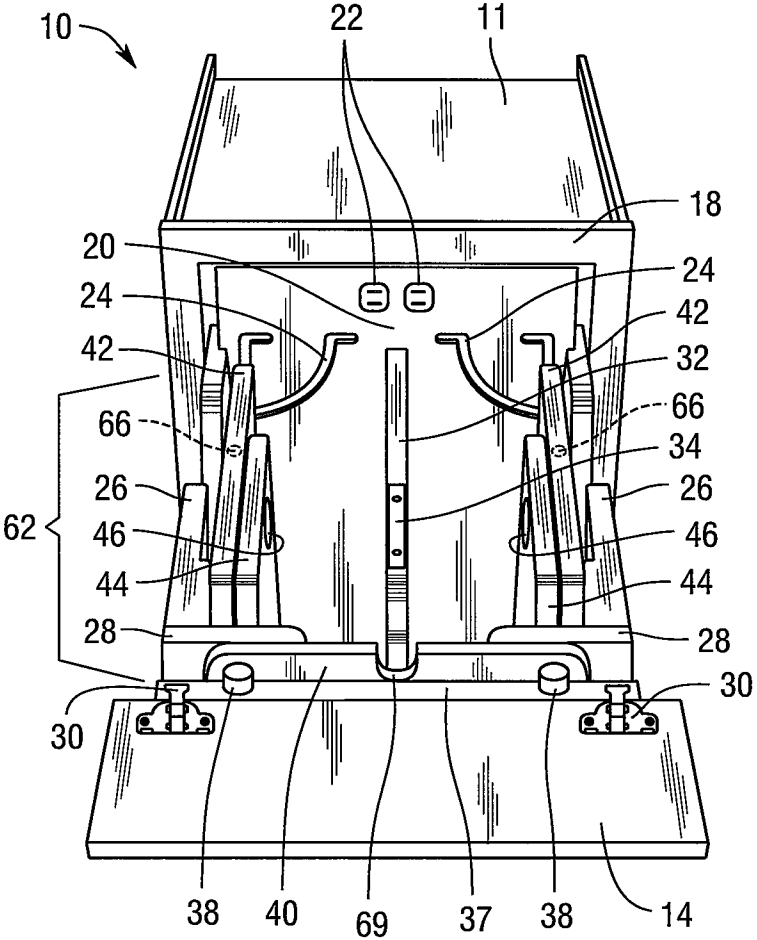
FIG. 5 is an elevated front view of the cabinet table in FIG. 2 illustrating the interior box in the open position and the upper balance plate piece in the unfolded, deployed position.

FIG. 5 shows the cabinet containing a fold out table 10 in a fully open position with a support wall 32, a key 34 in the support wall 32, two large table leafs 42, and two small table leafs 44. Each side plate 26 is attached to the front plate 28 and to the back plate 20. The support wall 32 is attached to the front plate 28 and the back plate 20, preferably at a location that is equidistant from each side plate 26.

Figure 11:
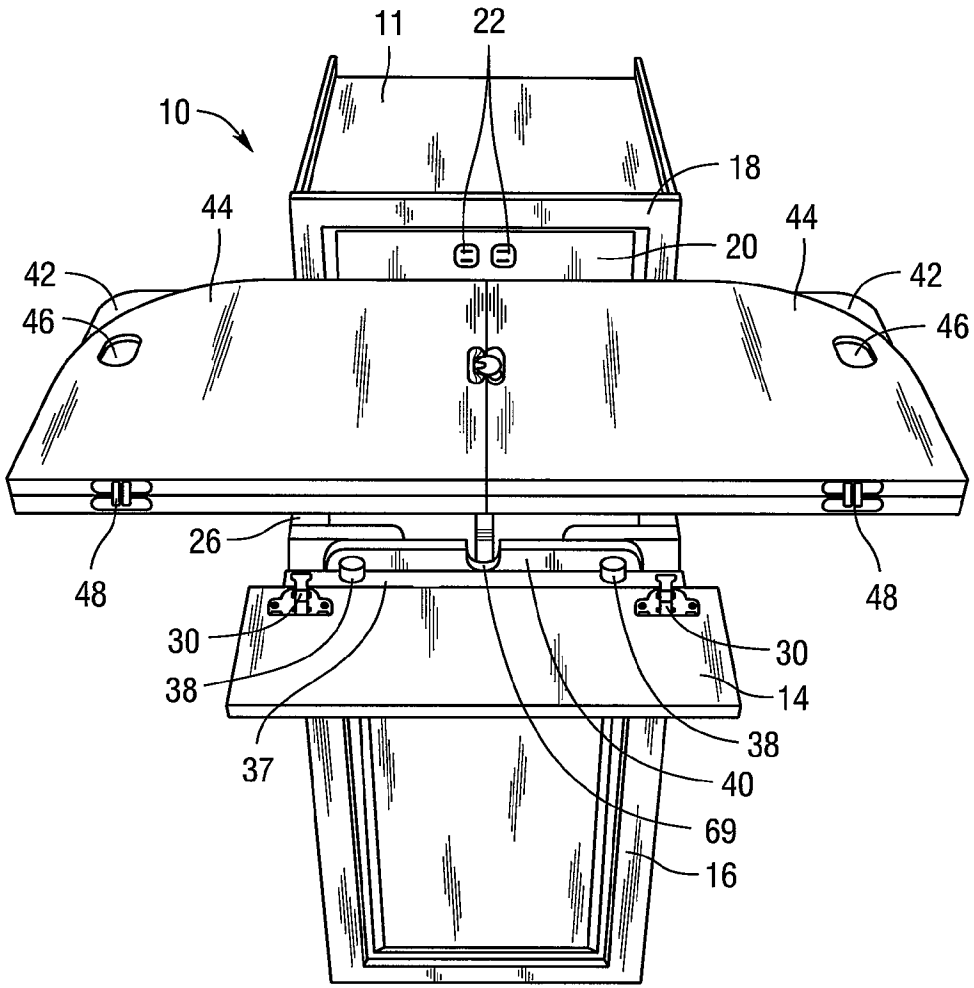
FIG. 11 is an elevated front view of the cabinet table shown in FIG. 9 illustrating the two table leafs in an external, horizontal, folded, and locked position.
Figure 12:
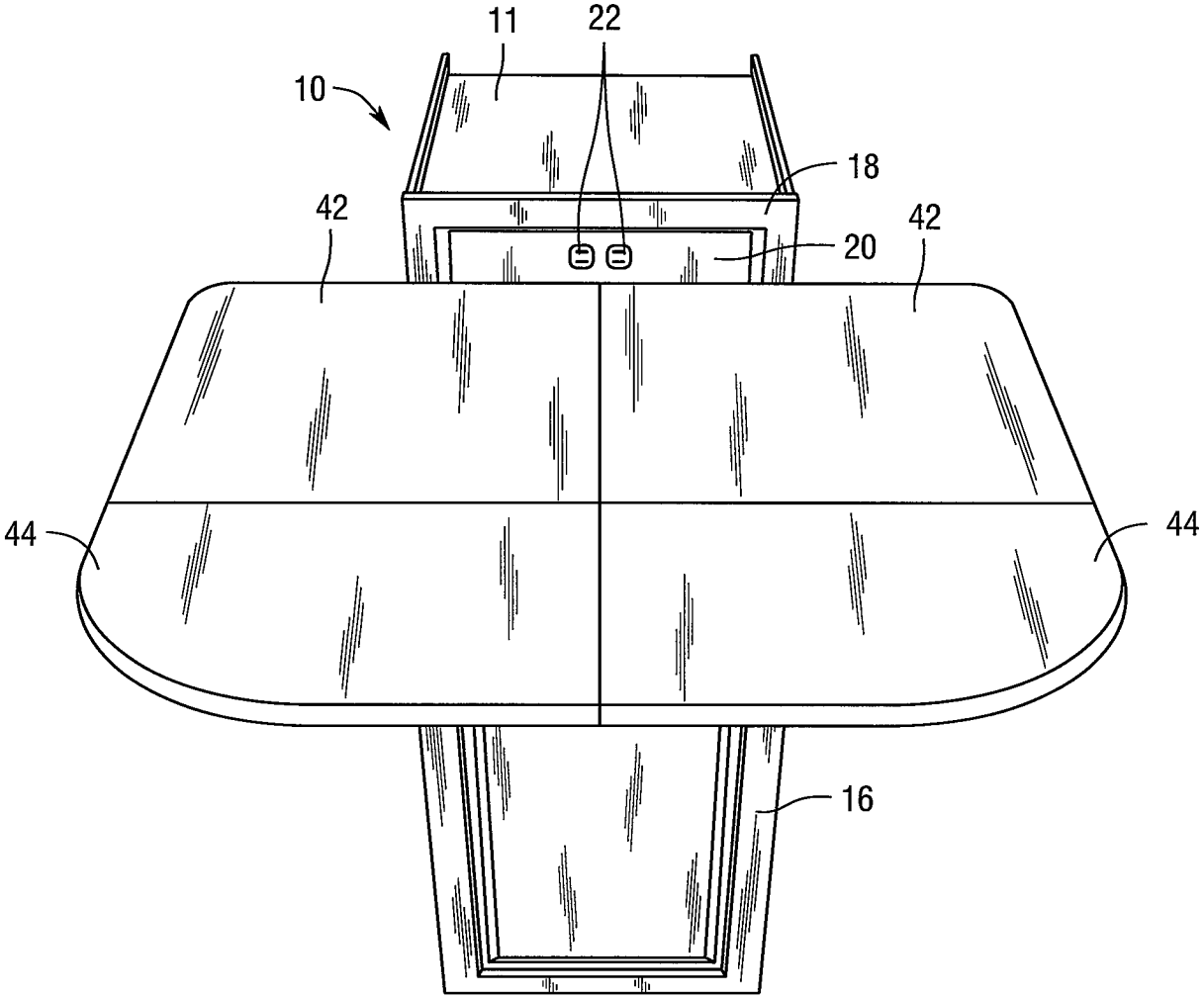
FIG. 12 is an elevated front view of the cabinet table shown in FIG. 9 illustrating four table leafs in an external, horizontal, unfolded, and locked position.

As shown in FIG. 5, the back plate 20 includes a receptacle 22, two slots 24, and two tracking mechanisms 25. While the only depiction of the receptacle 22 in the drawings is that of an electrical receptacle, other embodiments could include other types of receptacles, including, but not limited to, receptacles for telephone and internet connections. Each tracking mechanism 25 is attached to the side of a large table leaf 42. Each large table leaf 42 is attached to a small table leaf 44 by a leaf hinge 48, which allows the small table leafs 44 to remain in a folded position as shown in FIG. 11 or an unfolded position as shown in FIG. 12. Each large table leaf 42 and each small table leaf 44 contain a hand grip 46.

Figure 6:
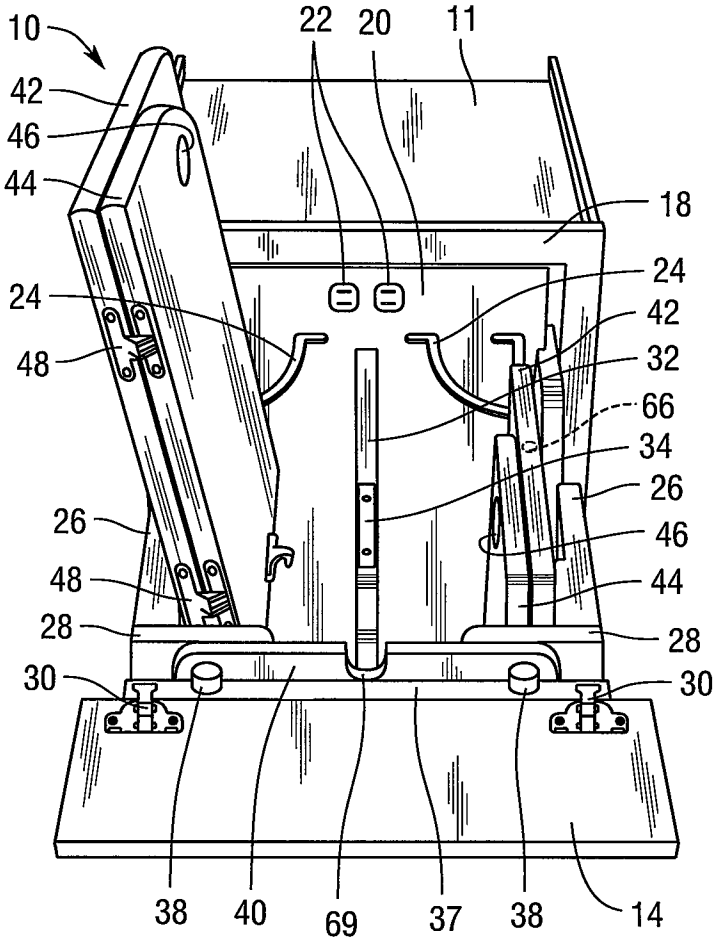
FIG. 6 is an elevated front view of the cabinet table in FIG. 2 illustrating certain table leafs in an external, vertical, folded, raised, and unlocked position.

Each large table leaf 42 is pivotably slidable to various positions without difficulty via the slot 24 and tracking mechanism 25. Each large table leaf 42 and small table leaf 44 is raised from the internal, folded position as shown in FIG. 5 by a slot 24 and tracking mechanism 25 to the folded, raised position as shown in FIG. 6. Each large table leaf 42 and small table leaf 44 is moveable from the folded, raised position as shown in FIG. 6 by the slot 24 and tracking mechanism 25 to the horizontal, folded, unlocked position as shown in FIG. 7.

Figure 7:
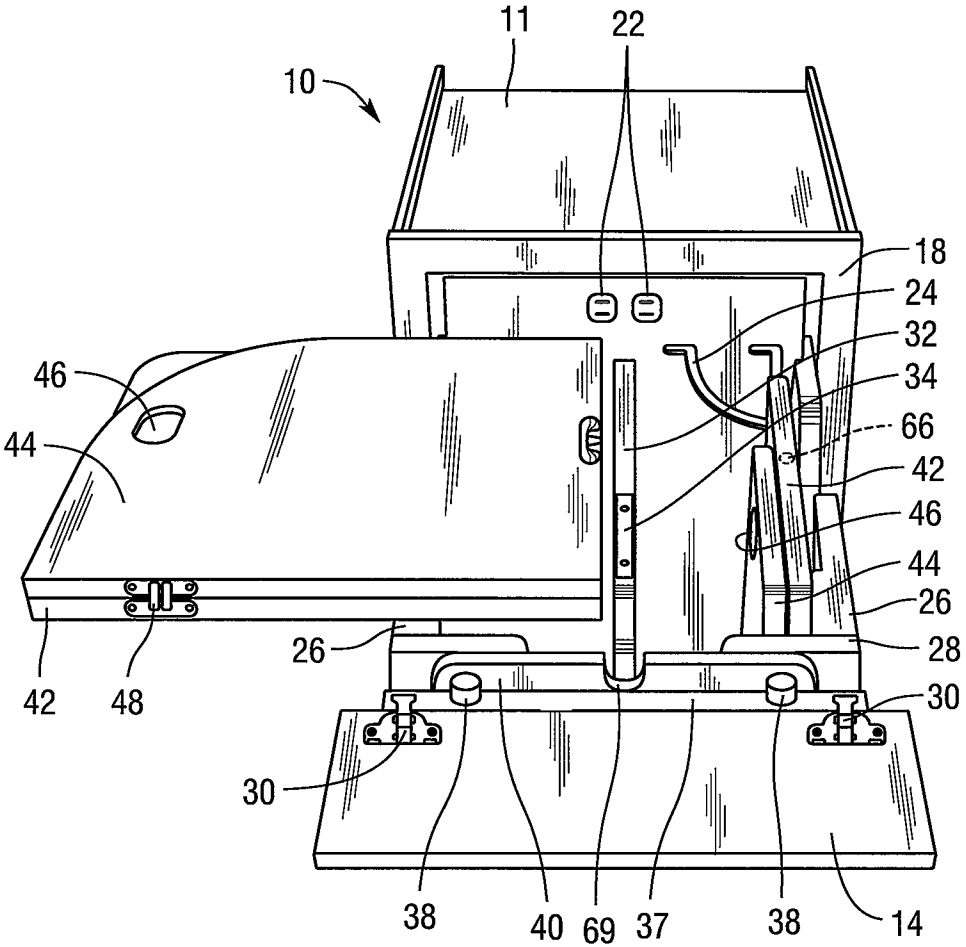
FIG. 7 is an elevated front view of the cabinet table in FIG. 2 illustrating certain table leafs in an external, horizontal, folded, and unlocked position.

As shown in FIG. 7, each large table leaf 42 contains a holding mechanism 66 which prevents the large table leaf 42 and small table leaf 44 from separating or flapping open as the large table leaf 42 and small table leaf 44 are moved from position to position. Preferably, this holding mechanism 66 is a rare earth magnet located near the surface of the large table leaf 42.

Figure 8:
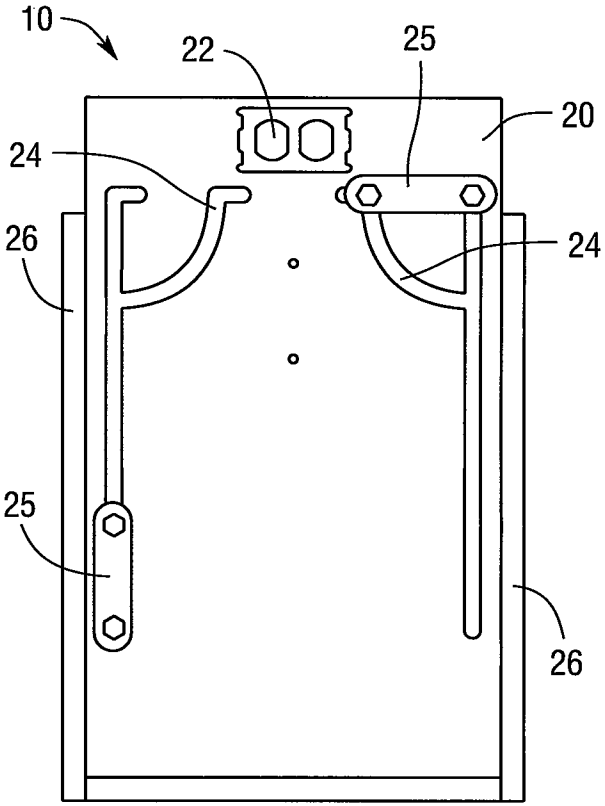
FIG. 8 is a sectional view of the posterior of the cabinet table in FIG. 2 from behind the cabinet table illustrating certain slots and tracking mechanisms.

FIG. 8 illustrates the cabinet containing a fold out table 10 shown in FIG. 7 from behind with one tracking mechanism 25 shown in the position it would have when one large table leaf 42 and one small table leaf 44 are in the vertical position and one tracking mechanism 25 shown in the position it would have when one large table leaf 42 and one small table leaf 44 are in the horizontal position.

One small table leaf 44 contains a lock prong 52, while the other small table leaf 44 contains a lock receiver 50. Both the lock prong 52 and the lock receiver 50 are preferably fixed to the center of the respective small table leaf 44. One small table leaf 44 contains at least one guide pin 36 and the other small table leaf 44 contains at least one corresponding guide pin hole on the respective interior surface.

Figure 10A:
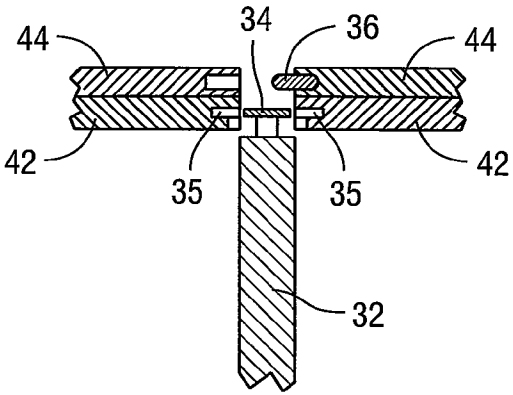
FIG. 10A is a sectional view of a key in relation to the two table leafs shown in FIG. 9 in an external, horizontal, folded, and unlocked position.
Figure 10B:
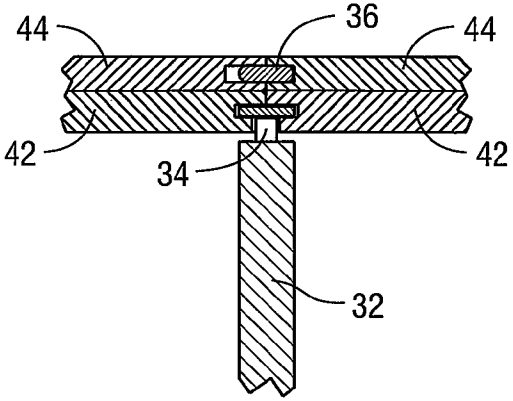
FIG. 10B is a sectional view of the key in relation to the two table leafs in an external, horizontal, folded, and locked position.
Figure 9:
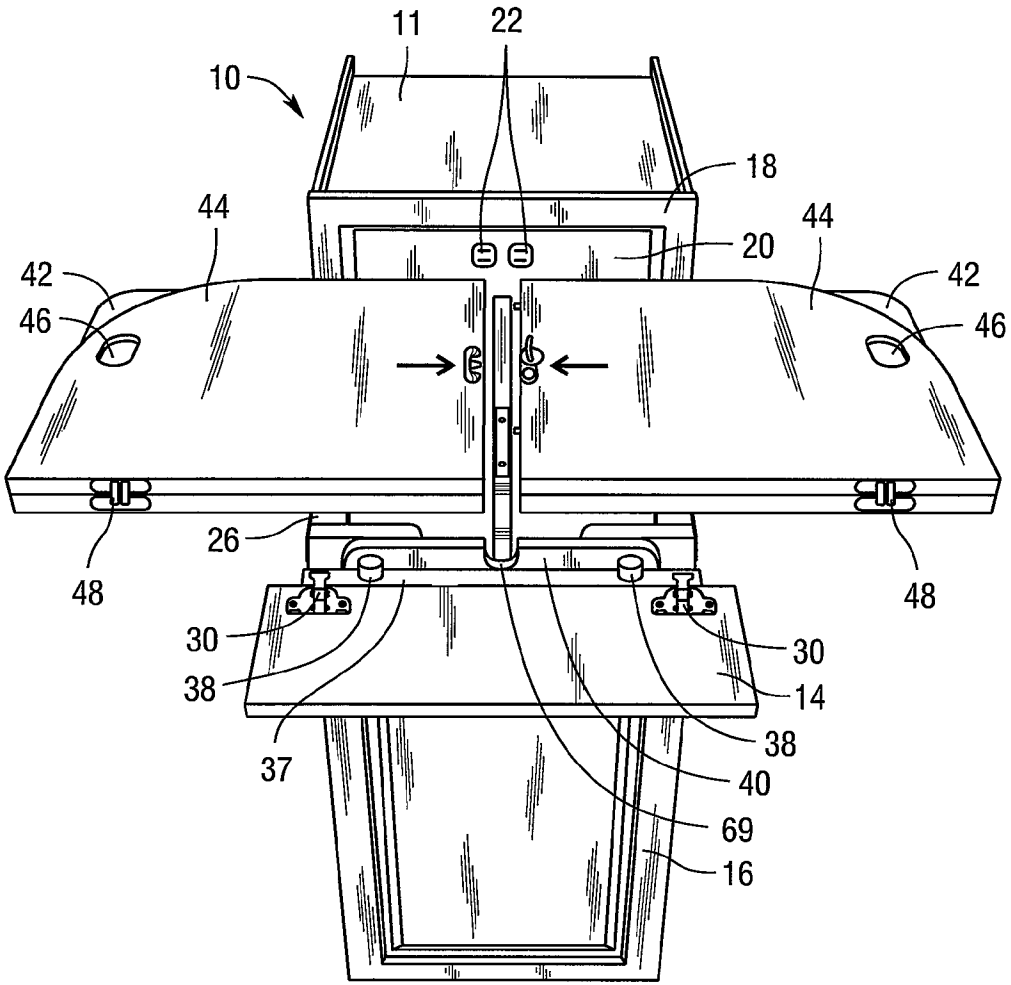
FIG. 9 is an elevated front view of the cabinet table shown in FIG. 7 illustrating two table leafs in an external, horizontal, folded, and unlocked position and showing the lock mechanism.

As shown in FIG. 9, each large table leaf 42 and small table leaf 44 in a horizontal, folded, unlocked position is moved horizontally and inwardly and then locked in the position shown in FIG. 11. Each large table leaf 42 contains a key notch 35 which allows the large table leafs 42 to slide together and lock via the key 34 as shown in FIG. 10A and FIG. 10B. The key notch 35 aids in the ability of the unfolded table to support substantial amounts of weight and downward force while maintaining a level surface.

Figure 13:
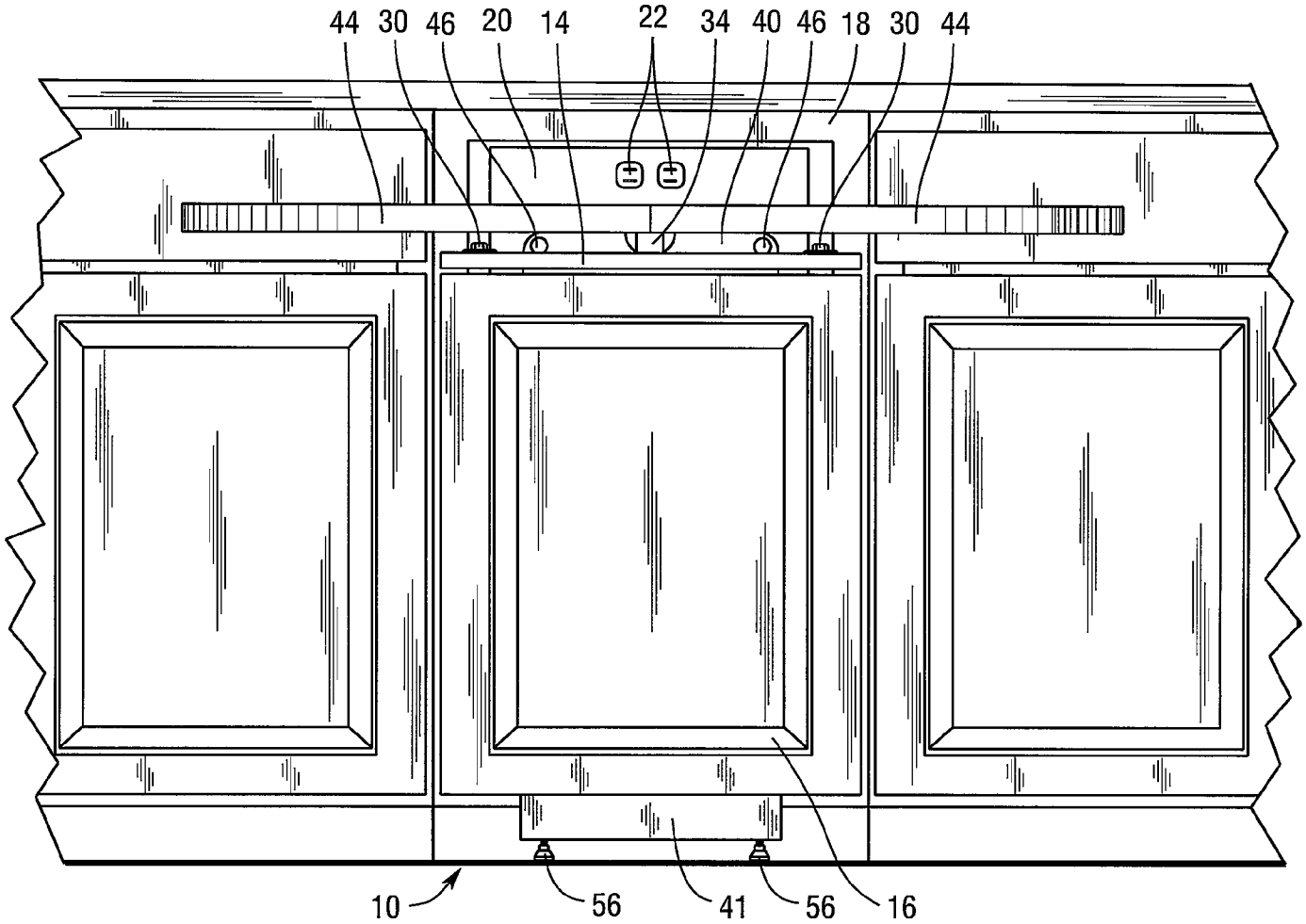
FIG. 13 is a front view of the cabinet table when in the open position shown in FIG. 12.

The small table leafs 44 are unfolded to create a table shown in FIG. 12 which is large enough to comfortably seat at least three adults. As shown in FIG. 13, the unfolded table top rests in a flat position with no interference from the upper balance plate piece 40 or other elements of the interior box 62.

Figure 14:
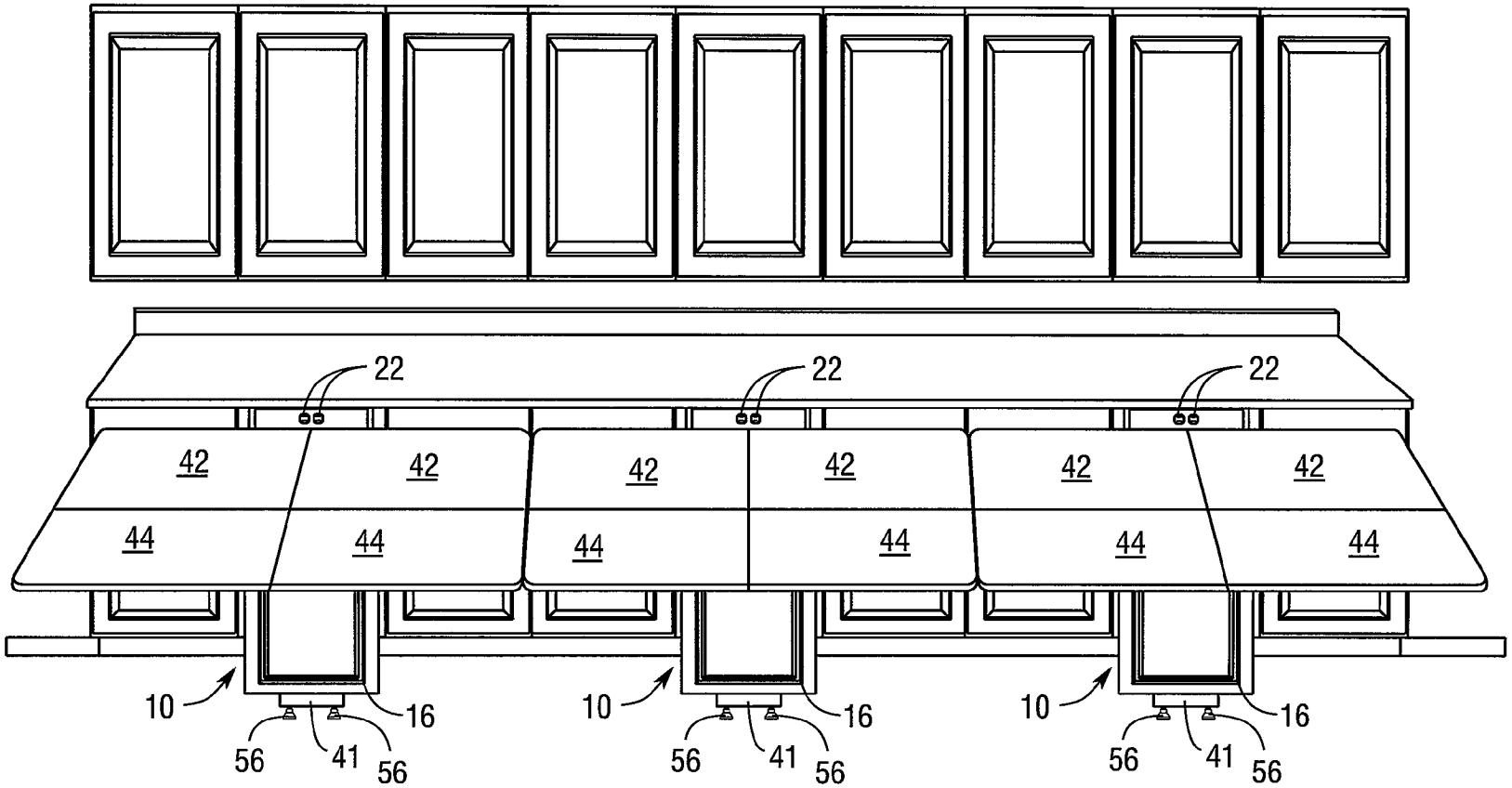
FIG. 14 is an elevated front view illustrating multiple tables according to the preferred embodiment oriented to form one continuous table.

The cabinet containing a fold out table 10 is retrofittable to various cabinet sizes and arrangements. As shown in FIG. 14, one preferred embodiment has a horizontal arrangement of multiple cabinets containing a fold out table 10 so that when the cabinet containing a fold out table 10 is in the open position, and the large table leafs 42 and small table leafs 44 are in the horizontal, unfolded position, a continuous table top surface can be created.

What is claimed is:

1. A cabinet table comprising:

a. a cabinet body;

b. a front face comprising a top front face and a bottom front face;

c. an interior box containing a plurality of table components, said interior box sliding in a horizontal direction perpendicular to said front face, said top front face and said bottom front face connected to said interior box, said top front face being rotatable from a vertical position to a horizontal position, wherein said plurality of table components includes:

i. at least one vertical support wall, said vertical support wall substantially in the middle of the interior box and perpendicular to said front face;

ii. a plurality of bisected table leafs each substantially in a position near the side of the interior box with said plurality of bisected table leafs adapted to be moved from a vertical storage position to a horizontal position, said vertical support wall supporting said plurality of table leafs when in said horizontal position and a securing mechanism to secure the table leafs in said horizontal position;

iii. a rear wall, said rear wall containing a slot and tracking mechanism, said slot and tracking mechanism guiding said table leafs from said vertical storage position to said horizontal position; and d. at least one sliding mechanism on the interior of the cabinet body, said at least one sliding mechanism permitting the interior box to slide out of the cabinet body.

2. The cabinet table according to claim 1, wherein said cabinet table has at least one plate located between the front face and the interior box, said plate being moveable in the vertical direction.

3. The cabinet according to claim 2, wherein said plate has at least one hand grip.

4. The cabinet according to claim 2, wherein said plate has at least one stopper.

5. The cabinet table according to claim 1, wherein said support wall contains a key.

6. The cabinet table according to claim 1, wherein at least one of said plurality of table leafs has a notch.

7. The cabinet table according to claim 4, wherein said cabinet table has a stopper located on said plate.

8. The cabinet table according to claim 1, wherein said cabinet table has adjustable feet.

9. The cabinet table according to claim 1, wherein at least one of said plurality of table leafs has a hand grip.

10. The cabinet table according to claim 1, wherein said cabinet table has a receptacle.

11. The cabinet table according to claim 1, wherein at least one of said plurality of table leafs contains a magnet.

12. The cabinet table according to claim 1, wherein said cabinet table contains toe space.

13. The cabinet table according to claim 1, wherein said plurality of table components contains enough space to provide storage for stools.

14. The cabinet table according to claim 1, wherein said slot comprises a horizontal element and an arcuate element.

15. The cabinet table according to claim 1, wherein said bisected table leafs are adapted to be moved in the vertical position.

16. The cabinet table according to claim 1, wherein said bisected table leafs are adapted to be moved in the horizontal position.

* * * * *